US011040233B2

(12) United States Patent
Sands

(10) Patent No.: US 11,040,233 B2
(45) Date of Patent: Jun. 22, 2021

(54) HANGER FOR ATTACHING RESISTANCE TO A BARBELL

(71) Applicant: William Matthew Sands, Rolla, MO (US)

(72) Inventor: William Matthew Sands, Rolla, MO (US)

( * ) Notice: Subject to any disclaimer, the term of this patent is extended or adjusted under 35 U.S.C. 154(b) by 117 days.

(21) Appl. No.: 16/513,659

(22) Filed: Jul. 16, 2019

(65) Prior Publication Data

US 2020/0023225 A1 Jan. 23, 2020

Related U.S. Application Data

(60) Provisional application No. 62/699,107, filed on Jul. 17, 2018.

(51) Int. Cl.

| | |
|---|---|
| ***A63B 21/078*** | (2006.01) |
| ***A63B 21/06*** | (2006.01) |
| ***A63B 21/072*** | (2006.01) |
| ***A63B 21/16*** | (2006.01) |
| ***A63B 21/00*** | (2006.01) |

(52) U.S. Cl.

CPC ..... *A63B 21/0609* (2013.01); *A63B 21/0724* (2013.01); *A63B 21/0726* (2013.01); *A63B 21/0728* (2013.01); *A63B 21/151* (2013.01); *A63B 21/16* (2013.01)

(58) Field of Classification Search

CPC ..... A63B 21/0609; A63B 21/072–075; A63B 21/02; A63B 21/04; A63B 21/0442; A63B 21/055–0557

See application file for complete search history.

(56) References Cited

U.S. PATENT DOCUMENTS

| | | | | |
|---|---|---|---|---|
| 4,890,831 | A * | 1/1990 | Craig | A63B 21/0724 482/104 |
| 5,891,004 | A * | 4/1999 | Berry | A63B 21/04 482/106 |
| 7,789,814 | B1 * | 9/2010 | Xu | A63B 21/0728 482/107 |
| 8,033,964 | B1 * | 10/2011 | Chen | A63B 21/00069 482/106 |
| 8,506,460 | B2 * | 8/2013 | Seitzer | A63B 21/065 482/106 |
| 2006/0105890 | A1 * | 5/2006 | Logue | A63B 21/0724 482/106 |
| 2008/0051262 | A1 * | 2/2008 | Striar | A63B 21/06 482/93 |
| 2014/0018214 | A1 * | 1/2014 | Jordan | A63B 21/0722 482/107 |
| 2014/0274593 | A1 * | 9/2014 | Kelly | A63B 21/4043 482/105 |

(Continued)

*Primary Examiner* — Joshua T Kennedy
(74) *Attorney, Agent, or Firm* — Rebecca L. Rich

(57) ABSTRACT

This device may be used for attaching accommodating resistance devices to a barbell, such as resistance bands or chains. The device is designed to attach to a barbell by sliding it onto the sleeve of a barbell, in the same way that weight plates slide onto the sleeves of the barbell. Once the device is installed on a barbell, the user is able to easily change resistance bands or add/subtract other weights by hanging them from a peg and/or holes in the device. The device may be used for any lift or lifts, but is especially suited to powerlifting movements such as squat, bench press, and deadlift.

16 Claims, 6 Drawing Sheets

(56) References Cited

U.S. PATENT DOCUMENTS

| | | | | |
|---|---|---|---|---|
| 2015/0114916 | A1* | 4/2015 | Tambornino | A63B 17/04 211/41.1 |
| 2015/0141214 | A1* | 5/2015 | Morway | A63B 21/0724 482/107 |
| 2018/0339183 | A1* | 11/2018 | Nieberding, III | A63B 21/0728 |
| 2020/0114193 | A1* | 4/2020 | Tabone | A63B 21/0783 |
| 2020/0238126 | A1* | 7/2020 | Anderson | A63B 21/075 |

* cited by examiner

-Prior Art-

HANGER FOR ATTACHING RESISTANCE TO A BARBELL

PRIORITY CLAIM

The present patent application claims priority benefit to U.S. Provisional Patent Application Ser. No. 62/699,107, filed Jul. 17, 2018, entitled "Hanger for Resistance Bands," and incorporated by reference in its entirety herein.

BACKGROUND OF INVENTION

Field of the Invention

This invention relates to a device for attaching accommodating resistance to a barbell.

Prior Art

Adjustable-weight barbells are often used for powerlifting or weightlifting exercises, such as squat, benchpress, or deadlift. The barbell is typically a metal bar with "sleeves" on each end onto which a number of disc-shaped weights (commonly known as "plates") of varying weights can be removably loaded by a user by inserting the sleeve through a corresponding hole in the center of the plate. Although the bar may be of varying lengths, diameters, and even shapes, the sleeves and corresponding holes in the center of the plates typically come in one of two sizes. If the barbell is intended to be utilized in conjunction with "Olympic" sized disc-shaped weights, each sleeve is approximately 2 inches in diameter. If the barbell is intended to be utilized in conjunction with "standard" sized disc-shaped weights, each sleeve is approximately 1 inch in diameter. The length of the barbell in between the sleeves typically is one inch in diameter, and often is roughened, or "knurled," to make the bar easier for the lifter to grip.

In addition to the disc-shaped weights, the difficulty of the barbell exercises can be altered by the use of accommodating resistance. When accommodating resistance is used, typically resistance bands or chains are attached to the barbell. When resistance bands are used, the resistance bands are typically a large rubber band, between 2 and 8 feet in circumference, and of varying thicknesses and widths. The resistance bands are typically attached to the barbell and are attached to one or more points above or below the barbell. Depending on where the bands are attached, they can cause the lifter to experience more or less downward force as compared to just the weight of the barbell and the weights. The force experienced by the lifter also changes as the barbell is moved through the lift. When chains are used, they are typically attached to the barbell and allowed to hang from the barbell. As the barbell is moved by the lifter, the chains may change from hanging freely to piling on the floor beneath the barbell, thereby changing the weight felt by the lifter through the course of the lift and providing additional instability to the movement.

When using bands as the accommodating resistance, the band is typically wrapped around the barbell, usually around the sleeves as shown in FIG. 1. Occasionally, the band 60 is wrapped around the inner portion of the barbell 70, but the knurl on the bar can damage the rubber of the bands, causing them to fray or even break. When the bar is wrapped around the sleeves 71 of the bar, it must be placed next to the plates either toward the center of the barbell (inside the plates) or away from the center of the barbell (outside of the plates). When the bands are inside of the plates, or toward the center of the barbell, it causes the weights to be spaced out further from the lifter, and the bands cannot be changed without first removing the plates from the barbell. When the bands are outside the weights, the weights inside the bands cannot be changed, which can cause difficulty when warming up or when multiple lifters are using the same bar. In FIG. 1, the bands 60 are also attached to an anchor 80.

One prior art method for attaching resistance bands is an attachment for the Duffalo Bar from Kabuki Strength. This attachment has pegs that can attach to the sleeves of a specially designed barbell. However, these pegs only work with one very specialized type of barbell. Because most gyms have multiple barbells that could benefit from the use of accommodating resistance, a new method of attachment that can be used with multiple types of bars is needed.

Additionally, chains or other weights may be attached to the bar. In one common prior art method, chains are simply draped over the barbell, or they may be attached to specially designed collars with attachment points that are placed on the sleeves either inside or outside the plates. It would be advantageous to have a single device that could be used as an attachment point for both bands and chains.

SUMMARY OF THE INVENTION

A device for attaching accommodating resistance to a barbell, such as resistance bands or chains, is disclosed. This device is designed to attach to a barbell by inserting the sleeve of a barbell into an opening in the device, in the same way that the weights slide onto the sleeves of the barbell. Once the device is installed on a barbell, the user is able to easily change resistance bands or add/subtract other weights by means of a peg and/or attachment points on the device. The device may be used for any lift or lifts, but is especially suited to powerlifting movements such as squat, bench press, and deadlift.

DETAILED DESCRIPTION OF THE INVENTION

Figures

INVENTIVE DEVICE

Figure 1:
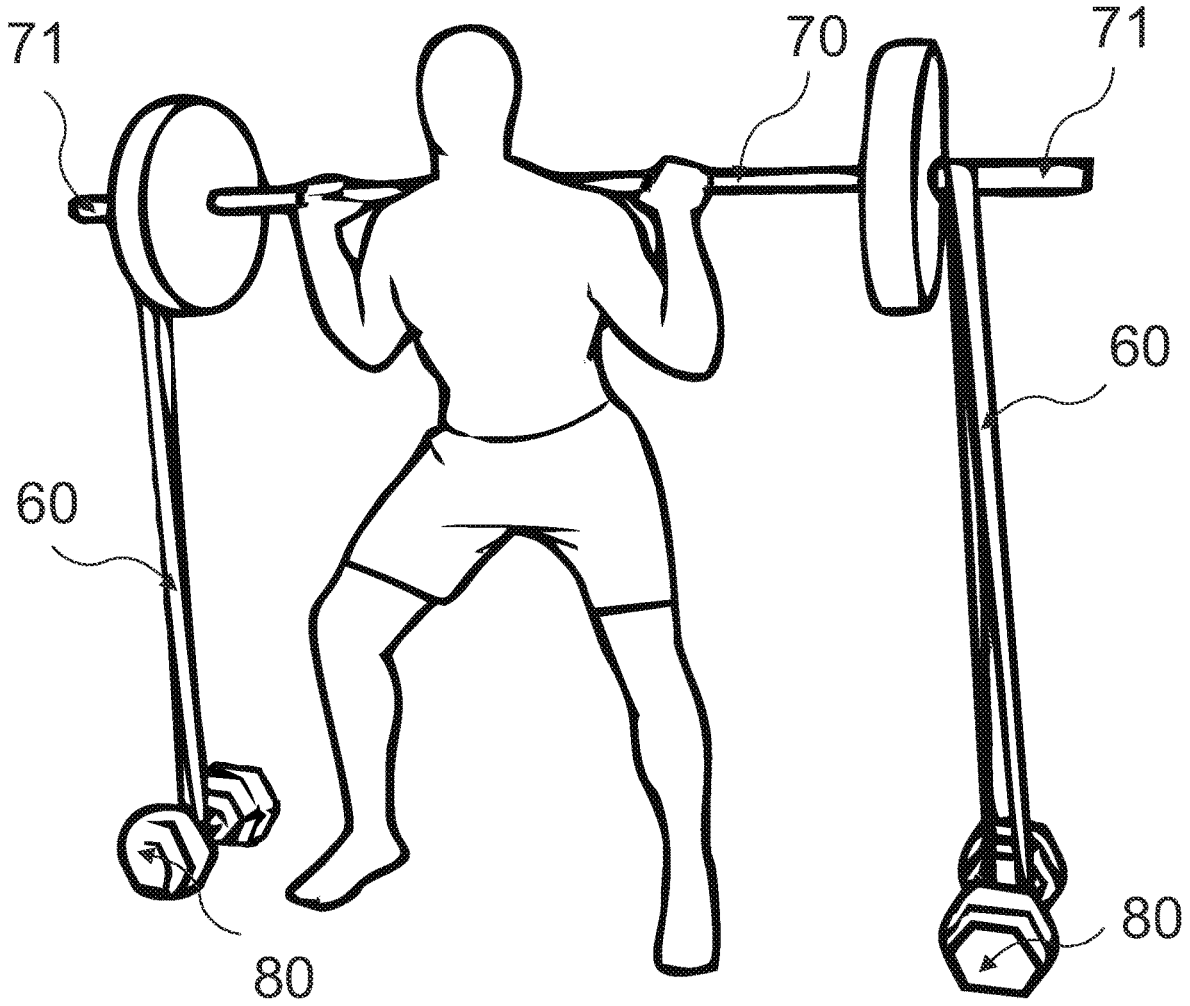
FIG. 1 is a prior art method of attaching resistance bands to a barbell.
Figure 2:
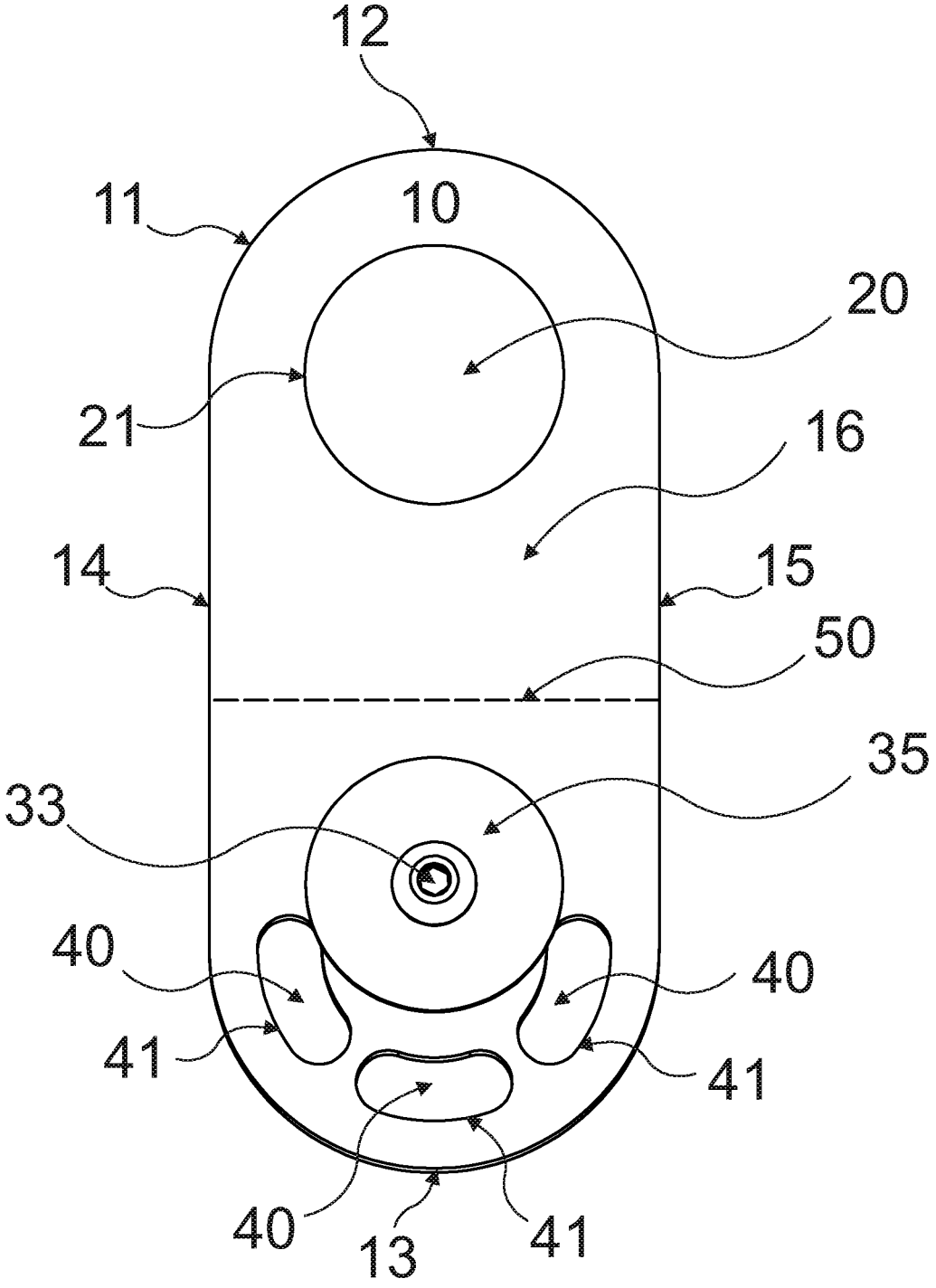
FIG. 2 is a front view of one embodiment of the hanger.
Figure 3:
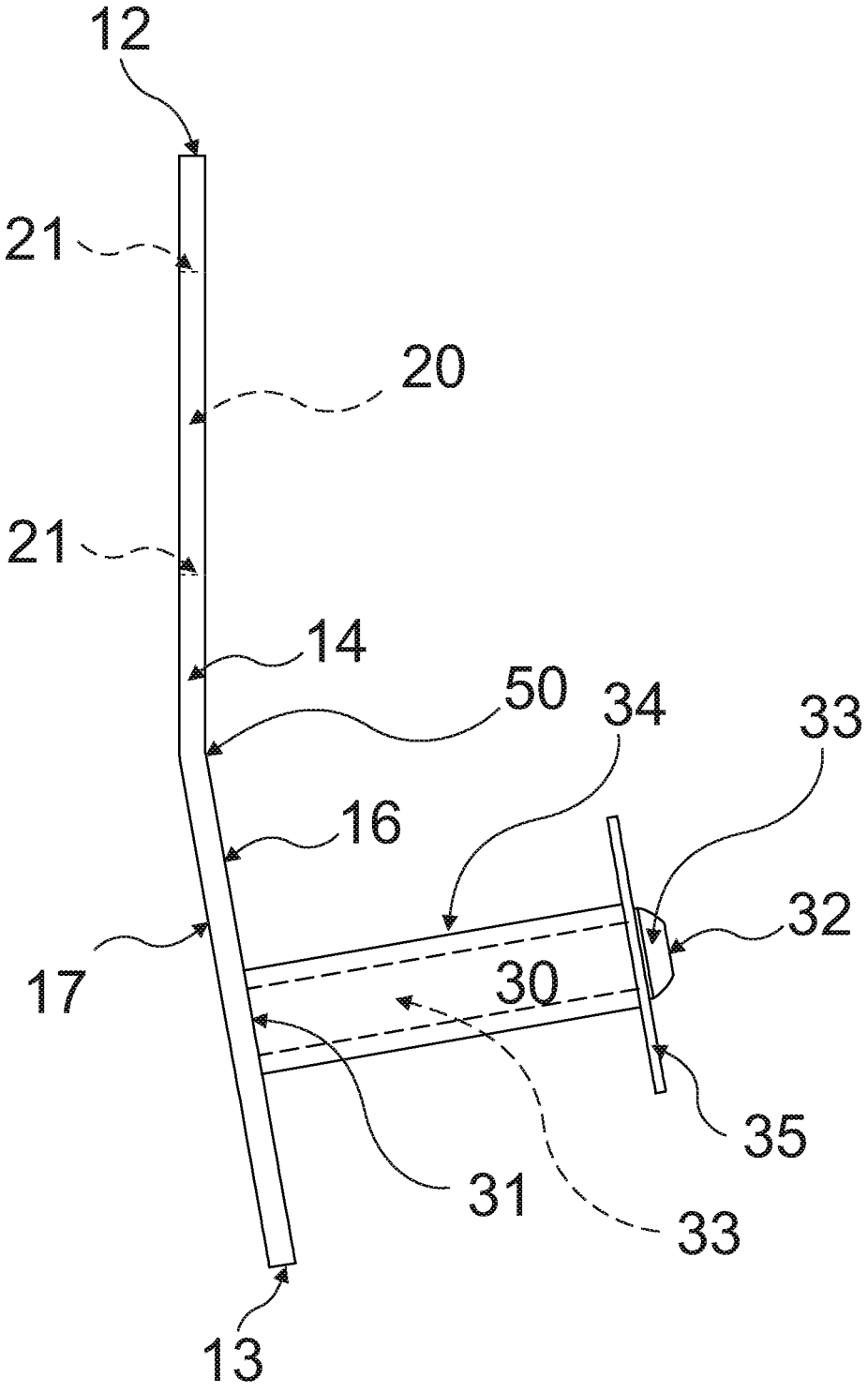
FIG. 3 is a side view of one embodiment of the hanger.

In more detail, FIG. 2 shows a front view of a first embodiment of hanger 10 and FIG. 3 shows a side view of the same hanger 10. Hanger 10 may be of any shape or shapes, but the outer edge 11 of hanger 10 may be is a rectangular, oval, triangular, or oblong shape. Hanger 10 has a first end 12 and a second end 13. The length of the hanger 10, that is, the distance between the first end 12 and the second end 13, is preferably from about 4 inches to about 9 inches, even more preferably from about 5 inches to about 8 inches, even more preferably about 5.5 inches. Hanger 10 has a first side 14 and a second side 15. The width of the hanger 10, that is, the distance between the first side 14 and the second side 15 of hanger 10, is preferably from about 2.5 inches to about 4 inches, more preferably about 3.5 inches. In one embodiment, first side 14 and second side 15 are substantially parallel. Hanger 10 has a first section and a second section. Hanger 10 has a first surface 16 and a second surface 17. The distance between the first surface 16 and second surface 17, that is, the thickness of the hanger 10, is preferably from about 0.180 inch to about 0.5 inch, more preferably from about 0.185 inch to about 0.35 inch, even more preferably about 0.1875 inch to about 0.25 inch.

Figure 4:
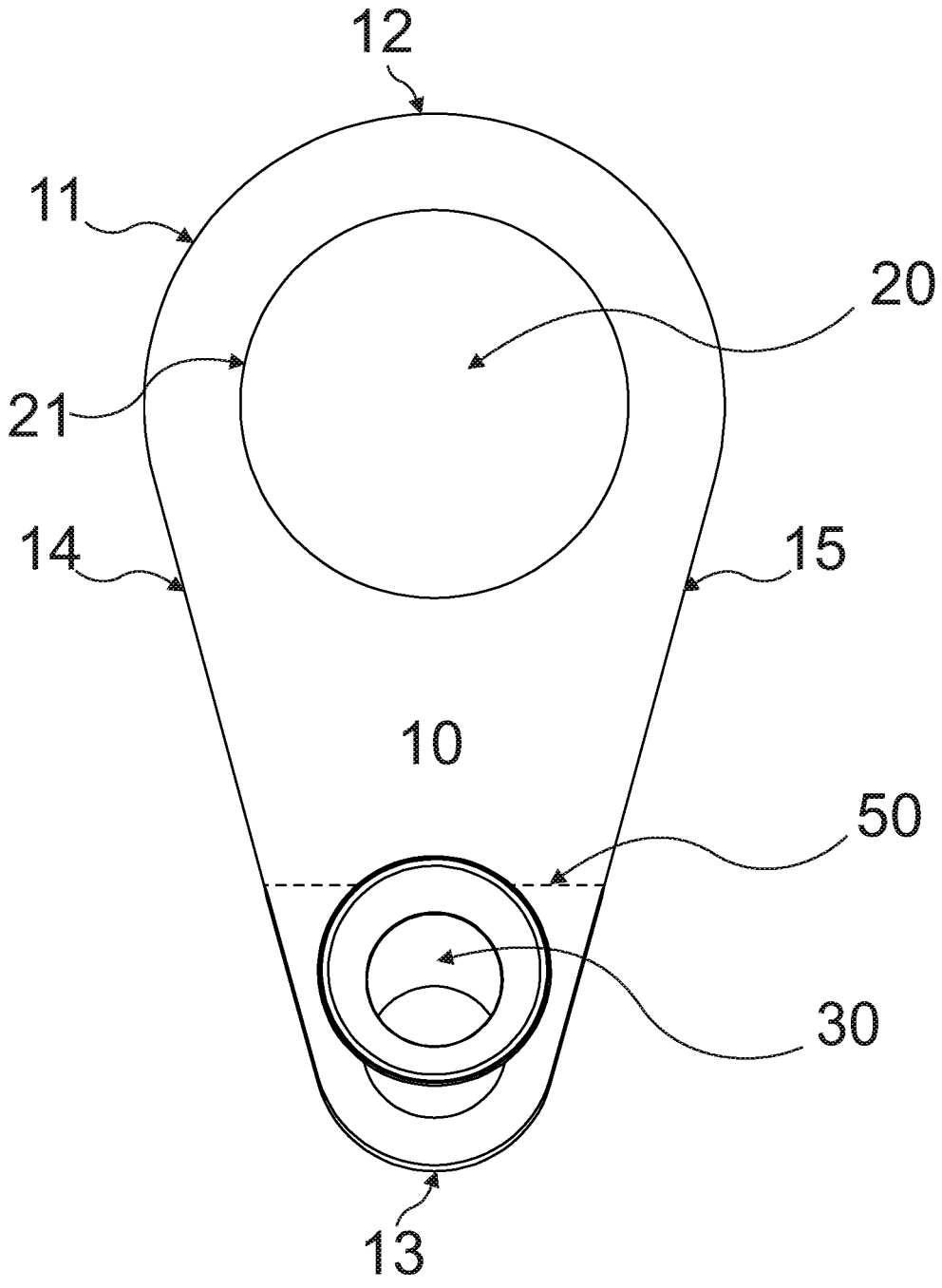
FIG. 4 is a front view of a second embodiment of the hanger.
Figure 5:
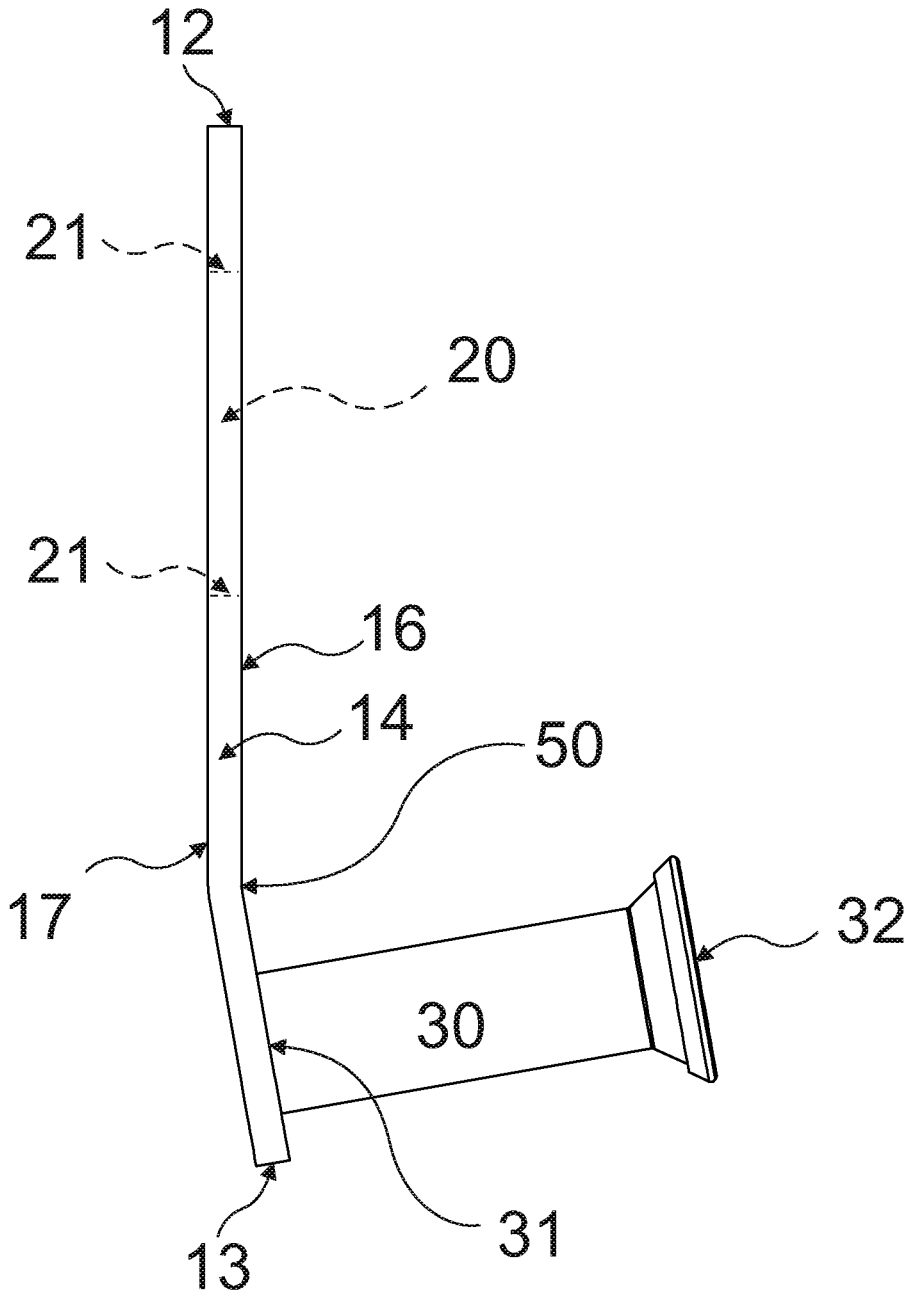
FIG. 5 is a side view of a second embodiment of the hanger.

In another embodiment, shown in FIGS. 4 and 5, first side 14 and second side 15 are not parallel, but are angled so that the distance between the first side 14 and second side 15 is greater than the distance between the first side 14 and the second side 15 in the second section of hanger 10. In this embodiment, the longest distance from the first side 14 to the second side 15 in the first section of hanger to is preferably from about 2.5 inches to about 4 inches, even more preferably about 3.5 inches. The average distance from the first side 14 to the second side 15 in the second section of hanger to is preferably from about 0.5 inch to about 4 inches, even more preferably from about 1 inch to 2 inches.

Barbell opening 20 is positioned in the first section of the hanger 10. The outer edge 21 of barbell opening 20 is preferably circular. It will be appreciated that barbell opening 20 will be sized according to size of the sleeve of the barbell for which the hanger will be used. For an Olympic barbell having a 2-inch-diameter sleeve, the diameter of barbell opening 20 is preferably at least about 2 inches, more preferably from about 2.01 inches to about 2.1 inches, even more preferably from about 2.02 inches to about 2.015 inches. For a standard barbell having a 1-inch-diameter sleeve, the diameter of the barbell opening 20 is preferably at least about 1 inch, more preferably from about 1.01 inches to about 1.1 inches, even more preferably from about 1.02 inches to about 1.03 inches. Barbell opening 20 is preferably positioned in the hanger such that its center is centered on the width of the hanger 10, that is, it is equidistant from the first side 14 and the second side 15 of hanger 10. As shown in FIGS. 3 and 5, the dashed lines indicate the position of the outer edge 21 of bar opening 20 through the thickness of hanger 10.

Peg 30 is positioned in the second section of hanger 10. Preferably, peg 30 is substantially cylindrical in shape and has a first end 31 with a first diameter and a second end 32 with a second diameter. Peg 30 may be hollow or may be solid. The first end 31 of peg 30 is preferably positioned adjacent to hanger 10 such that its center is centered on the width of the hanger, that is, it is equidistant from the first side 14 and the second side 15 of hanger 10. Peg 30 is preferably positioned so that its length is substantially perpendicular to the first surface 16 of hanger 10. Peg 30 may be of one continuous piece, or it may comprise many pieces. Preferably, the diameter of the second end 32 of peg 30 is equal or greater than the first diameter 31 of peg 30. In the embodiment shown in FIGS. 2 and 3, peg 30 comprises a bolt 33 that is threaded into the body of hanger 10, a sleeve 34, and a washer 35. In this embodiment, the washer 35 provides a larger diameter at the second end 32 of peg 30 than at the first end 31 of peg 30. In the embodiment shown in FIGS. 4, 5, and 6 peg 30 is of one continuous piece. In this embodiment, the second end 32 of peg 30 is flared to provide a larger diameter than at first end 31 of peg 30.

FIG. 2 also shows optional attachment openings 40 that may be positioned in the second section of hanger 10. The outer edge 41 of the attachment openings 40 may be of any number and shape. The attachment openings allow various objects to be attached to the hanger, such as more bands or chains. In many cases, the object is attached using a fastener such as a carabiner, so it will be appreciated that the size of the attachment opening 40 must be of a large enough size that the fastener can pass through the opening. The width of the attachment opening 40 is preferably at least about 0.5 inch, more preferably from about 1 inch to about 1.5 inches, even more preferably from about 1.1 inches to about 1.3 inches. The height of the attachment opening 40 is preferably at least about 0.5 inch, more preferably from about 0.6 inches to about 1 inch.

Optionally, hanger 10 may be slightly angled at line 50. Angle 50 is between the first section and second section of hanger 10. Angle 50 is preferably positioned from about 2.5 inches from the first end 12 of hanger 10 to about 6 inches from the first end 12 of hanger 10, more preferably from about 3 inches from the first end 12 of hanger 10 to about 4 inches from the first end 12 of hanger 10. The angle formed at line 50 will preferably be from about 165 degrees to about 180 degrees, more preferably from about 169 degrees to about 171 degrees with respect to the first surface 16 of hanger 10. It will be appreciated that more than one angle may be incorporated into hanger 10 to achieve the desired placement of the accommodating resistance.

Figure 6:
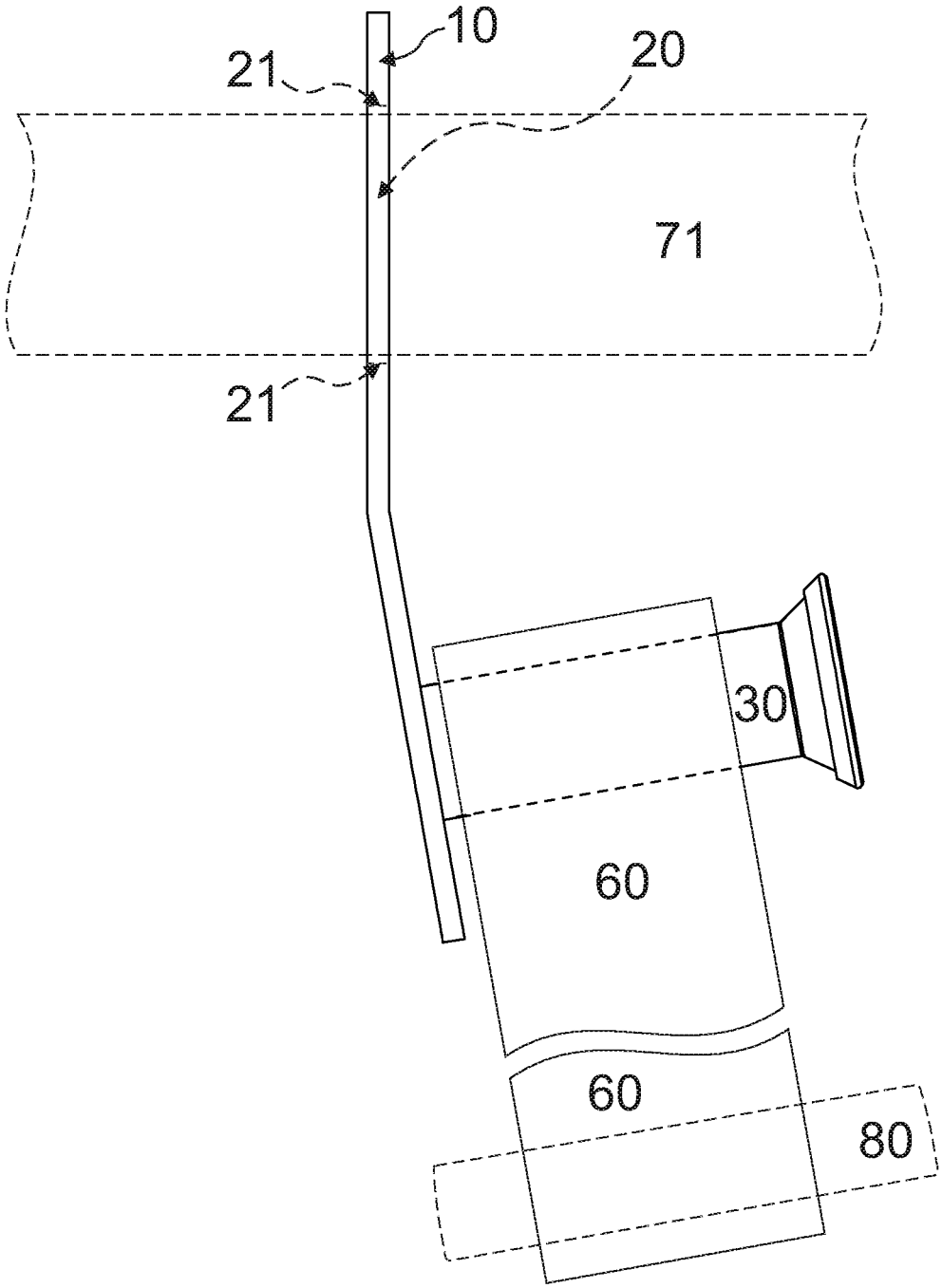
FIG. 6 is a side view of a third embodiment of the hanger with a resistance band, and anchor, and a barbell.

FIG. 6 shows a side view of hanger 10 shown in combination with a barbell sleeve 71 and accommodating resistance in the form of a band 60. In this view, the position of the barbell sleeve 71 is shown through barbell opening 20. Band 60 is wrapped around peg 30 and anchor 80.

Bar hanger 10 may be of any material or materials, but is preferably comprised of steel, iron, aluminum, and combinations thereof. The bar hanger 10 may have an optional surface finish such as powder coating or anodizing.

It will be appreciated that depending on the material of construction and dimensions, the weight of bar hanger 10 may vary. Bar hanger 10 weighs preferably from about 0.5 pound to about 5 pounds, more preferably from about 1 pound to about 3 pounds, even more preferably from about 2 pounds to about 2.5 pounds.

Unless otherwise specifically noted, articles depicted in the drawings are not necessarily drawn to scale. Modifications, additions, or omissions may be made to the apparatuses described herein without departing from the scope of the disclosure. For example, the components of the systems and apparatuses may be integrated or separated. Moreover, the operations of the systems and apparatuses disclosed herein may be performed by more, fewer, or other components.

Method of Use

The bar hanger 10 is used by inserting a sleeve 71 of barbell 70 in to the opening 20 of the bar hanger. When the bar hanger 10 is used in a position on the barbell sleeve closest to the center of barbell 70, first surface 16 of bar hanger 10 and peg 30 are preferably facing toward the center of the barbell 70. This allows access to peg 30 when plates are loaded onto the sleeve 71 of the barbell. When weights are placed onto sleeve 71 of barbell 70 closer to the center of barbell 70 than bar hanger 10, first surface 16 of bar hanger 10 and peg 30 are preferably facing away from the center of the barbell 70.

When a band is used as accommodating resistance 60, the band is preferably wrapped around peg 30 and is also wrapped around an anchor 80 as shown in FIG. 6. When a resistance band is used to add weight to the lift, anchor 80 can include any stationary object that is attached to a point lower than the barbell 70 or is heavier than the force of the resistance band. When a resistance band is used to subtract weight from the lift, anchor 80 can include any stationary point above the barbell 70. It will be appreciated that when the anchor 80 is above the barbell 70, that bar hanger 10 will be "upside down," that is, first end 12 of bar hanger 10 will be closer to the floor than second end 13 of bar hanger 10. In some embodiments, anchor 80 is a peg attached to a power rack or monolift, or can be part of the structure of the power rack or monolift. In other embodiments, anchor 80 may be a hook or loop anchored to the floor, wall, or ceiling. It will be appreciated that multiple anchors 80 may be used for a single band, that is, one band may be anchored at more than one point.

Alternatively, if the accommodating resistance 60 that is used is one or more chains or similar weights, it will be appreciated that no anchor 80 is necessary, as the chains will hang down due to gravity and will provide additional weight to the barbell 70. In this embodiment, the chains may be attached to peg 30 or to one or more attachment opening 40.

Although one hanger 10 may be used, it is expected that two hangers 10 are to be used with one barbell 70. A first sleeve 71 of barbell 70 is inserted into bar opening 20 of a first hanger 10, and a second sleeve 71 of barbell 70 is inserted into bar opening 20 of a second hanger 10. A first accommodating resistance 60 is attached to the first hanger 10 and an optional first anchor 80, and a second accommodating resistance 60 is attached to the second hanger 10 and an optional second anchor 80. It will be appreciated that disc-shaped weights may be placed on the first and second sleeves of barbell 70 adjacent to the first sides of the first and second barbell hanger, the disc-shaped weights may be placed on the first and second sleeves of barbell 70 adjacent to the second sides of the first and second barbell hanger, or a combination thereof.

As the lifter moves the barbell, the downward force experienced by the lifter may change through the course of the lift. In arrangements where the anchor 80 is below the barbell, the downward force experienced by the lifter is more than the weight of the barbell and any weights loaded onto the barbell, and the downward force experienced by the lifter is more at the top of the lift than the bottom of the lift. In arrangements where the anchor 80 is above the barbell, the downward force experienced by the lifter is less than the weight of the barbell and any plates loaded onto the barbell, and the downward force experienced by the lifter is more at the top of the lift than the bottom of the lift. Alternatively, bar hanger 10 may be used to freely hang additional chains or weights from barbell 70, which forces the lifter to accommodate for the additional instability of the weights hanging from the barbell.

I claim:

1. An apparatus for attaching accommodating resistance to a barbell, comprising:

a hanger with a first surface, a second surface opposite the first surface, a first section, and a second section opposite the first section;

wherein the hanger defines an obtuse angle in the first surface between the first section and the second section;

a first opening in the first section from the first surface through the hanger to the second surface of the hanger, said first opening having a diameter configured to accept a barbell sleeve; and a peg, where said peg has a first end adjacent to first surface of the second section of the hanger and a second end spaced from the hanger, the second section having a diameter larger than a diameter of the first section configured to maintain said accommodating resistance on said peg.

2. The apparatus of claim 1, where the peg is of one piece with the hanger.

3. The apparatus of claim 1, where the peg is of a separate piece than the hanger.

4. The apparatus of claim 1, where the second end of the peg is of one piece with the first end of the peg.

5. The apparatus of claim 1, where the second end of the peg is of a separate piece than the first end of the peg.

6. The apparatus of claim 1, where the angle is about 170 degrees.

7. The apparatus of claim 1, where the distance between the first surface and the second surface is from about 0.180 inch to about 0.5 inch.

8. The apparatus of claim 1, further comprising at least one second opening passing through the hanger from the first surface to the second surface of the second section of the hanger.

9. The apparatus of claim 1, where the hanger is made from a material selected from the group consisting of steel, iron, aluminum, and combinations thereof.

10. The apparatus of claim 1, where the hanger weighs less than 2.5 pounds.

11. An exercise system combination comprising:

a barbell comprising a first sleeve and a second sleeve;

a first and second apparatus, each of said first and second apparatus comprising:

a hanger with a first surface, a second surface opposite the first surface, a first section, and a second section opposite the first section;

wherein the hanger defines an obtuse angle in the first surface between the first section and the second section;

a first opening in the first section from the first surface through the hanger to the second surface of the hanger, said first opening having a diameter configured to accept a barbell sleeve, and a peg, where said peg has a first end adjacent to first surface of the second section of the hanger and a second end spaced from the hanger, the second section having a diameter larger than a diameter of the first section configured to maintain said accommodating resistance on said peg;

wherein said first sleeve is passed through the first opening of the first apparatus and said second sleeve is passed through the first opening of the second apparatus.

12. The exercise system of claim 11, further comprising accommodating resistance attached to the first apparatus and accommodating resistance attached to the second apparatus.

13. The exercise system of claim 12, where the accommodating resistance is attached to the peg of the apparatus.

14. A method of exercising comprising:

a barbell comprising a first sleeve and a second sleeve;

a first and second apparatus, each of said first and second apparatus comprising:

a hanger with a first surface, a second surface opposite the first surface, a first section, and a second section opposite the first section;

wherein the hanger defines an obtuse angle in the first surface between the first section and the second section;

a first opening in the first section from the first surface through the hanger to the second surface of the hanger, said first opening having a diameter configured to accept a barbell sleeve, and a peg, where said peg has a first end adjacent to first surface of the second section of the hanger and a second end spaced from the hanger, the second section having a diameter larger than a diameter of the first section configured to maintain said accommodating resistance on said peg;

passing said first sleeve through the first opening of the first apparatus and passing said second sleeve through the first opening of the second apparatus;

attaching accommodating resistance to said first apparatus;

attaching accommodating resistance to said second apparatus; and lifting said barbell.

15. The method of claim 14, where the accommodating resistance is a band.

16. The method of claim 14, where the accommodating resistance is one or more chains.

* * * * *